United States Patent [19]

Maleyko et al.

[11] Patent Number: 4,776,585

[45] Date of Patent: Oct. 11, 1988

[54] ELECTRICALLY LIGHTED JUMP ROPE

[76] Inventors: John R. K. Maleyko, 609 Belle River Rd., Belle River, Ontario, Canada, N0R 1A0; Gerald Grijak, 4721 Pickwick Dr., Sterling Heights, Mich. 48077

[21] Appl. No.: 30,664

[22] Filed: Mar. 27, 1987

[51] Int. Cl.[4] ..... A63B 5/20

[52] U.S. Cl. ..... 272/75; 439/13; 200/11 G

[58] Field of Search ..... 272/74, 75; 446/485; 310/232; 200/11 G, 19 DC; 439/13, 27

[56] References Cited

U.S. PATENT DOCUMENTS

| | | | |
|---|---|---|---|
| 1,436,703 | 11/1922 | Fisher | 272/75 |
| 1,820,681 | 8/1931 | Schmalbach . | |
| 2,416,802 | 3/1947 | Roung | 310/232 X |
| 2,871,455 | 1/1959 | Richardson | 439/27 |
| 3,030,460 | 4/1962 | Huetten et al. | 200/11 G |
| 3,778,053 | 12/1973 | Smith, III et al. | 272/75 |
| 4,215,264 | 7/1980 | Hetherington | 439/13 X |
| 4,336,974 | 6/1982 | Wilson | 439/13 |
| 4,527,847 | 7/1985 | Rinker | 439/13 |
| 4,529,193 | 7/1985 | Kuhnsman | 272/75 |
| 4,540,225 | 9/1985 | Johnson et al. | 439/13 X |
| 4,605,219 | 8/1986 | Mahana et al. | 272/75 |

FOREIGN PATENT DOCUMENTS

| | | | |
|---|---|---|---|
| 1264838 | 5/1961 | France | 446/485 |
| 2276069 | 1/1976 | France | 272/75 |
| 16952 | of 1891 | United Kingdom | 272/75 |

*Primary Examiner*—V. Millin
*Assistant Examiner*—David J. Bender
*Attorney, Agent, or Firm*—Reising, Ethington, Barnard, Perry & Milton

[57] ABSTRACT

An electrically lighted jump rope is disclosed with a flexible tube of light transmitting material and handles rotatably mounted thereon at each end. A tube fitting and handle fitting at each end are coupled together for rotation relative to each other about an axis of rotation extending axially of the tube. A battery is disposed in one of the handles and a lighting circuit including a plurality of LEDs extends into the tube. The battery is connected to the lighting circuit through brushes and slip rings on the tube and handle fittings.

4 Claims, 2 Drawing Sheets

ELECTRICALLY LIGHTED JUMP ROPE

FIELD OF THE INVENTION

This invention relates to jump ropes; more particularly, it relates to an electrically lighted jump rope.

BACKGROUND OF THE INVENTION

Heretofore, there have been attempts by others to construct an electrically lighted jump rope for the purpose of enhancing the enjoyment of the person using the jump rope or enhancing the entertainment of others viewing the jump rope in motion. Such devices have been less than successful for several reasons. There has been difficulty in supplying sufficient electric power to energize a sufficiently large number of light sources to provide a desired intensity, pattern and distribution of light emanating from the rope. In addition, there has been difficulty in providing light sources which are small enough to fit within the rope. Also, the light sources in such devices have lacked the necessary ruggedness to withstand the shock and acceleration forces resulting from swinging and impacting of the jump rope on the ground. In addition, the prior art devices have not satisfactorily solved the problem of preventing wind-up of the jump rope between the handles while supplying electric power from a handle to light sources in the rope. The known prior art is described below.

The Kuhnsman U.S. Pat. No. 4,529,193 granted July 16, 1985 discloses a lighted jump rope wherein a set of optical fibers of varying length extends into the rope from each of the handles. Each set of fibers is lighted at the handle by a lamp in the handle which is energized from a battery and switch arrangement in the handle. A rigid connection is provided between the ends of the transparent or translucent tube containing the fibers and the respective handles.

French Pat. No. 2,276,069 dated Jan. 23, 1976 discloses an illuminated jump rope comprising a transparent or translucent tube with a pair of handles rotatably mounted at opposite ends. A lighting circuit includes a plurality of colored lamps disposed in the tube. The lighting circuit is energized from a battery in each handle through slip rings and brushes in each handle. For rotational mounting of the handles, each end of the rope is provided with a yoke and the handle is mounted by bearings on the yoke for rotation about an axis perpendicular to the axis of the tube.

The Schmalbach U.S. Pat. No. 1,820,681 granted Aug. 25, 1931, discloses a jump rope which is provided with a plurality of spaced lamps which are disposed exteriorly of the rope and which are surrounded by balloons. The lamps are energized by batteries in the handles.

A general object of this invention is to provide an improved electrically lighted jump rope which overcomes certain disadvantages of the prior art.

SUMMARY OF THE INVENTION

In accordance with this invention, an electrically lighted jump rope is provided which is of rugged construction and which is economical to manufacture. Further, the jump rope is provided with a multiplicity of low power to discrete light sources which may be energized for a very long time period from self-contained batteries. The jump rope is provided with handles extending axially of the rope and which avoid the problem of rope wind-up between the handles and, at the same time, accommodate a lighting circuit extending from a handle into the rope.

Further, according to this invention, an electrically lighted jump rope comprises a flexible tube of light transmitting material with handles rotatably mounted at each end. A tube fitting is non-rotatably attached to each end and a handle fitting is non-rotatably attached to each handle. The tube fitting and handle fitting at each end are coupled together for rotation relative to each other about an axis of rotation extending axially of the tube. A battery is disposed in one of the handles and a lighting circuit including a plurality of light sources extends into the tube through means on the tube and handle fittings for electrically connecting the battery and lighting circuit during relative rotation of the fittings.

Further, according to the invention, the light sources are light emitting diodes (LEDs). The LEDs are preferably spaced along the tube at intervals to obtain a desired lighting effect.

Further, according to the invention, the handle fitting comprises a socket and the tube fitting comprises a stem rotatably mounted in the socket with retaining means for preventing axial separation.

Further, according to the invention, the means for electrically connecting the lighting circuit with the battery comprises a pair of slip rings and brushes on the tube fitting and handle fitting respectively.

Further, according to the invention, the lighting circuit comprises a pair of conductors extending into the tube with the LEDs connected in parallel thereacross through a switch on one of the handles.

A complete understanding of this invention may be obtained from the detailed description that follows taken with the accompanying drawings.

BEST MODE FOR CARRYING OUT THE INVENTION

Figure 1:
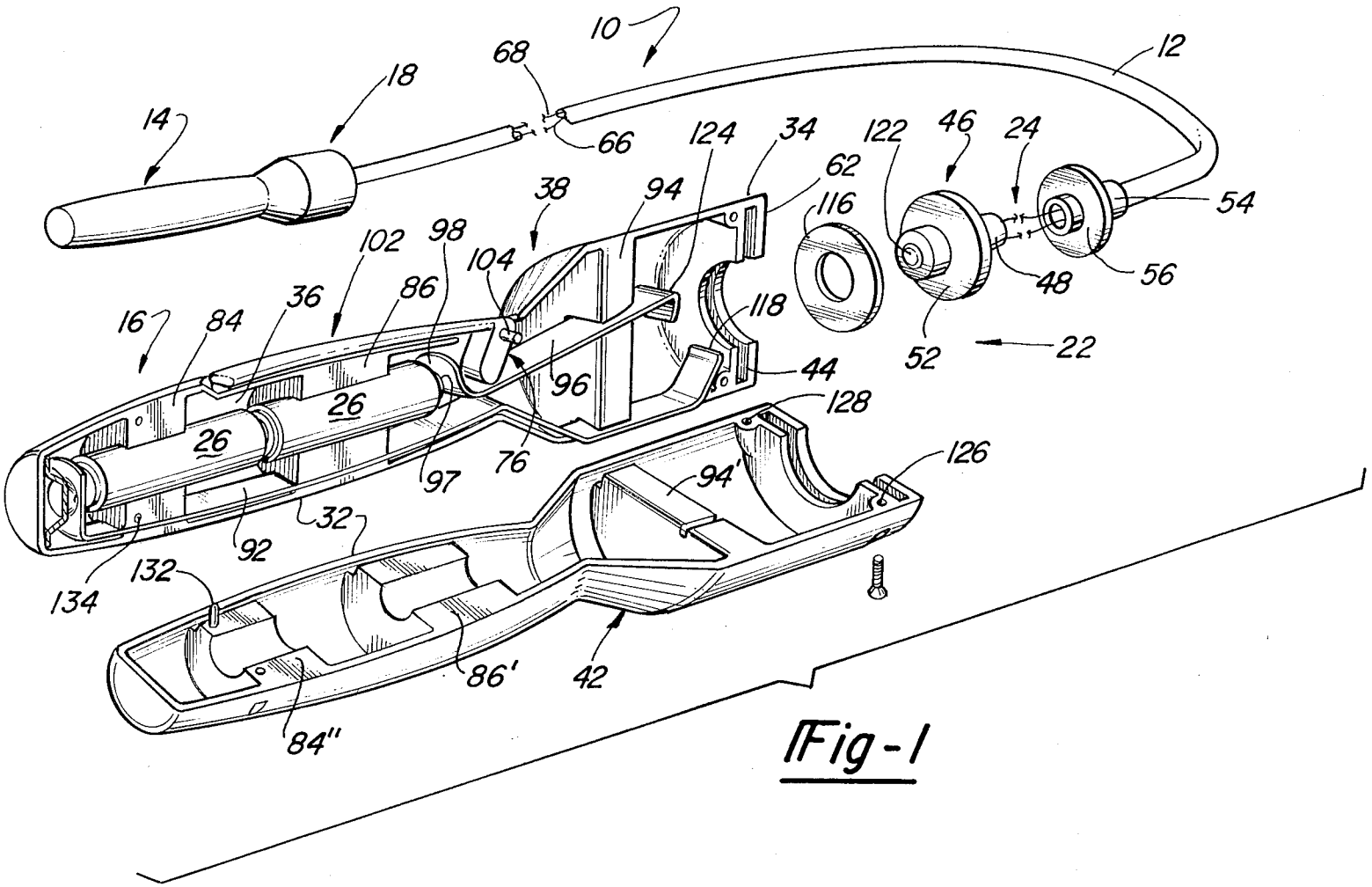
FIG. 1 shows a perspective view of the jump rope of this invention with a portion thereof shown in an exploded view.

This invention will now be described in detail with reference to the illustrative embodiment shown in the drawings.

As shown in FIG. 1, a electrically lighted jump rope 10 comprises, in general, a light transmitting tube 12 (which constitutes the "rope") with a pair of handles 14 and 16 rotatably mounted at opposite ends of the tube by rotary joints 18 and 22. A lighting circuit 24 extends into the tube 12 from the handle 16 and is energized by a pair of batteries 26 in the handle through the rotary joint 22.

Figure 2:
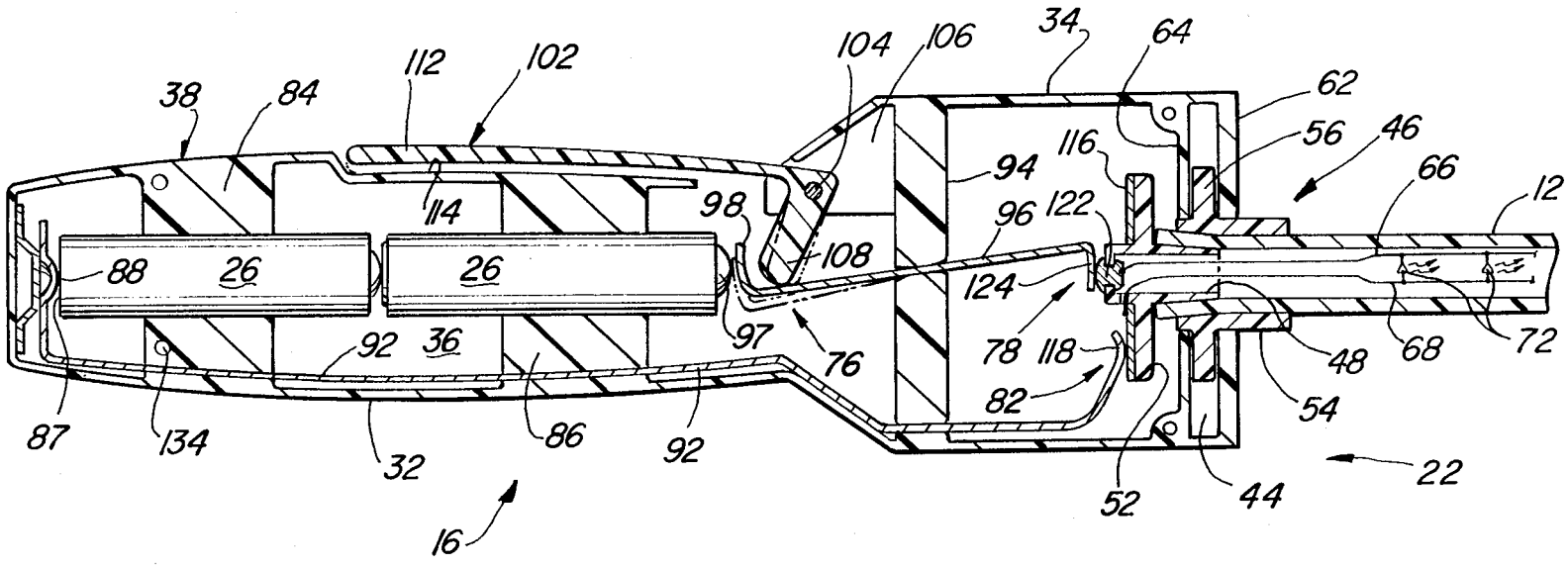
FIG. 2 is a cross-sectional view of a portion of the jump rope.

The jump rope will be described in greater detail with reference to FIGS. 1 and 2. The hollow tube 12 is constructed of light transmissive material, preferably translucent although it may be desirable in some cases to use a transparent material. A material having the requisite flexibility and durability for the tube 12 is a commercial grade of nylon tubing of ⅜" diameter. The connection of the tube 12 to the respective handles 14 and 16 and the disposition of the lighting circuit 24 therein will be described presently.

The handle 16 and the rotary joint 22 will now be described. The handle 16 comprises a cylindrical hand grip 32 and a hollow cylindrical body 34 unitary therewith. The hand grip 32 is hollow and provides a battery compartment 36 which contains the pair of batteries 26. For assembly purposes and for replacement of the batteries, the handle 16 is constructed of two complementary parts, a housing 38 and a cover 42. The housing 38 and cover 42 are of similar, but not identical construction and are joined together in a plane through the longitudinal center line of the handle. Both the handle and the cover are constructed of molded plastic. Before describing the electrical connection of the batteries 26 with the lighting circuit 24, the connection of the tube 12 to the handle 16 will be described.

As mentioned above, the tube 12 is connected with the handle 16 through a rotary joint 22. The rotary joint 22 comprises a handle fitting or socket 44 and a tube fitting or stem assembly 46. The tube fitting 46 comprises a tubular tapered stem 48 which is hollow and which carries a unitary circular flange 52 located intermediate the ends of the stem 48. One end of the stem 48 has a tapered outer surface and is adapted to receive the end of the tube 12 in a snug fit. A sleeve 54 is adapted to fit over the tube 12 in a slideable fit and to compress the end of the tube 12 against the tapered end of the stem 48. The sleeve 54 is provided with a unitary circular retaining disk 56. Both the stem 48 and the sleeve 54 are made of molded plastic. The remaining structure of the tube fitting or stem assembly 46 will be described subsequently in connection with the electrical circuit.

The rotary joint 22 also comprises the handle fitting or socket 44 which is disposed at the end of the cylindrical body 34. The socket 44 is formed by an end wall 62 on the cylindrical chamber 34 and by an interior wall 64. The circular retaining disk 56 is disposed between the end wall 62 and the interior wall 64 in the socket 44 with the sleeve 54 protruding through circular openings in both walls. Thus, the tube fitting or stem assembly 46 is freely rotatable with respect to the handle fitting or socket 44 but the tube fitting is axially restrained against motion by the retaining disk 56 in the socket 44. It is noted that the tube fitting or stem assembly 46 holds the tube 12 in a captured relationship between the sleeve 54 and the tubular stem 48 by reason of the taper thereof which tends to increase the gripping effort when pulling force is exerted on the tube 12.

The lighting circuit 24 comprises a pair of conductors 66 and 68 extending into the tube 12 from the handle 16. A plurality of LEDs 72 are connected in parallel with each other across the conductors 66 and 68. The LEDs are adapted to be energized from the battery voltage to emit light of substantial intensity in the visible portion of the spectrum. Each LED is connected by its respective terminals to the conductors 66 and 68, suitably by a solder connection without need for any special housing or mounting. The LEDs are spaced along the length of the tube 12 by intervals which may range from 4 to 15 inches depending upon the desired number of LEDs and the desired pattern in the resultant lighting effect. The LEDs may be of the same color or different colors as desired.

The lighting circuit comprising the LEDs 72 is energized from the batteries 26 which are included in a power supply circuit. The power supply circuit comprises, in general, the batteries 26, a switch 76 and a pair of rotary electrical connectors 78 and 82. The batteries 26 are held in the battery compartment 36 in a series connection with each other. The batteries are retained by respective bulkheads 84 and 86. The negative terminal 87 of one battery is seated against an electrical contact 88 at the end of an electrical conductor 92 which preferably takes the form of a spring metal strip. The conductor 92 is held in position by the slots in the bulkheads 84 and 86 and extends through a slot in an additional bulkhead 94 to the rotary electrical connector 82. A conductor 96, in the form a spring metal strip, is supported in a slot in the bulkhead 96 and is adapted to electrically connect the positive terminal 97 of the other battery 26 to the rotary electrical connector 78. For this purpose, the end of the conductor 96 is formed as a moveable switch contact 98 and in its rest or unstressed condition it is spaced from the positive terminal 97 of the battery 26. The positive terminal 97 serves as the fixed contact of the switch 76. The switch 76 is provided with a switch actuator in the form of a bell crank lever 102 which is pivotally mounted to the housing 38 by a cylindrical pivot pin 104 which is unitary with a boss 106 in the housing 38. The bell crank lever 102 has an arm 108 which rests against the spring conductor 96 when the conductor is in its unstressed condition. The lever 102 also has an arm 112 which is disposed in an elongated recess 114 on the exterior surface of housing 38. In the unactuated position, as shown in full lines in FIG. 2, the arm 112 is spaced from the bottom of the recess 114 and is held in that position by reason of the arm 108 resting against the undeflected spring conductor 96. The switch 76 is actuated to the closed position, as shown in interrupted lines, in which contact 98 engages contact 97 by deflection of the arm 112 into the recess. This occurs when a person's hand grips the handle 16. When the grip is released, the switch 76 is opened by the resiliency of the spring conductor 96 which causes the moveable contact 98 to move to its undeflected position, as shown in full lines in FIG. 2.

The rotary electrical connector 82 comprises a rotary slip ring 116 in the form of a conductive metal disk mounted on the face of the circular flange 52 of the tube fitting 46. The slip ring 116 of the rotary electrical connector 82 is engaged by a brush contact 118 which is unitary with the end of the spring conductor 92. The slip ring 116 is electrically connected with the conductor 68 of the lighting circuit 24. The rotary electrical connector 78 comprises a rotary slip ring 122 which is formed as a metal insert in the end of the tubular stem 48. A brush contact 124 is formed on the end of the conductor 96 and is unitary therewith and engages the slip ring 122. The slip ring 122 is electrically connected with the conductor 66 of the lighting circuit 24.

As mentioned above, the cover 42 of handle 16 is similar to the housing 38 and is complementary therewith in forming the handle 16. The exterior wall of the cover 42 is of the same configuration as the exterior wall of the housing 38. The cover 42 is provided with bulkheads 84', 86', and 94' which are provided with slots to accommodate the conductors 92 and 96 in the same manner as bulkheads 84, 86 and 94. The cover 42 is attached to the housing 38 by a pair of screws which extend through screw holes 126 and 128 in cover 42 into the corresponding screw holes in the housing 38. Also, a pilot pin 132 unitary with the cover 42 extends into a pilot hole 134 on the bulkhead 84' extends into a mating hole 134 in the bulkhead 84. The third screw (not shown) extends through a screw hole 136 in the bulkhead 84' into a corresponding screw hole in the bulkhead 84.

The handle 14 is suitably of the same construction as handle 16 except that it is not provided with batteries or any other of the electrical components. The rotary joint 18 is of the same construction as the rotary joint 22 except, of course, there is no need to provide slip rings corresponding to slip rings 116 and 122. Further, the bell crank lever 102 may be omitted from the handle 14. The ends of the conductors 66 and 68 extend to the handle 14 and are suitably insulated from each other and anchored, by means not shown, so that the lighting circuit remains in place within the tube 12.

In use of the jump rope of this invention, the handles 14 and 16 are grapsed by the user in a conventional manner. The grasping of the handle 16 causes the switch 76 to be actuated so that the LEDs are energized by the batteries 26. When the handle 16 is released, the switch is deactuated and the LEDs are turned off and the battery power is conserved. When the user is using the jump rope in the conventional skip rope fashion, i.e. swinging it continuously overhead and underfoot, the handles 14 and 16 are rotated relatively to the tube 12 through the rotary joints 18 and 22 respectively. Thus, there is no wind-up of the tube by reason of the continuous skip rope action. Electric power is continuously supplied to the LEDs during the skip rope action through the rotary electrical connectors 78 and 82. The entertainment effect of the lighted jump rope is most pronounced in dim ambient light or darkness. Each of the LEDs appears to produce a continuous band or ring of light defined by its orbital path as a result of the persistance of vision of the person viewing the use of the jump rope.

Although the description of this invention has been given with reference to a particular embodiment, it is not to be construed in a limiting sense. Many variations and modifications will now occur to those skilled in the art. For a definition of the invention, reference is made to the appended claims.

What is claimed is:

1. An electrically lighted jump rope comprising:

a flexible tube of light transmitting material having first and second tube ends, first and second handles, first and second tube fittings non-rotatably attached in coaxial relation, to said first and second tube ends, first and second handle fittings, respectively, integral with said first and second handles and being coaxial therewith, each of said handle fittings comprising a wall adjacent one end of said handle and having an opening therein, each of said tube fittings comprising a stem and a disk, means for non-rotatably connecting the respective tube end to the stem, said tube end extending through said opening and said disk being disposed inside said wall, and means including said wall for retaining said disk against axial movement in either direction, said first tube fitting and first handle fitting being coupled together for rotation relative to each other about an axis of rotation extending axially of said first handle and said first end of said tube, said second tube fitting and second handle fitting being coupled together for rotation relative to each other about an axis of rotation extending axially of said second handle and said second end of said tube, said first handle being adapted to contain at least one battery, a lighting circuit including a plurality of light sources extending into said tube, and a pair of slip rings on said first tube fitting and a pair of brushes in said first handle fitting said pair of brushes coacting respectively with said pair of slip rings for electrically connecting said lighting circuit with said battery during relative rotation of said first fittings.

2. The electrically lighted jump rope as defined in claim 1 wherein:

said lighting circuit comprises a pair of conductors connected respectively with said pair of slip rings, a plurality of LEDs connected in parallel across said pair of conductors, and a switch connected in one of said conductors and mounted on said first handle for controlling energization of said LEDs by said battery.

3. The electrically lighted jump rope as defined in claim 1 wherein:

said pair of slip rings comprises a conductive annular path on said disk and a conductive element on the end of said stem.

4. The electrically lighted jump rope as defined in claim 1 wherein said means for non-rotatably connecting comprises:

a tapered portion on said stem and a sleeve member disposed over said stem and adapted to engage said wall, said tube being disposed between said tapered portion and said sleeve member.

* * * * *